United States Patent [19]

Suzuki

[11] Patent Number: 4,974,394

[45] Date of Patent: Dec. 4, 1990

[54] CUTTING AND SORTING APPARATUS

[75] Inventor: Hiroaki Suzuki, Kanagawa, Japan

[73] Assignee: Fuji Photo Film Co., Ltd., Kanagawa, Japan

[21] Appl. No.: 403,966

[22] Filed: Sep. 7, 1989

[30] Foreign Application Priority Data

Sep. 8, 1988 [JP] Japan ..... 63-225277

[51] Int. Cl.[5] ..... B65B 5/12; B65B 63/00; B65B 5/08

[52] U.S. Cl. ..... 53/435; 53/475; 53/51; 53/520; 53/246; 83/371

[58] Field of Search ..... 53/520, 266 C, 435, 53/51, 55, 475, 459, 567, 570, 250; 83/371

[56] References Cited

U.S. PATENT DOCUMENTS

| | | | |
|---|---|---|---|
| 3,457,697 | 7/1969 | Engelstein | 53/520 |
| 4,003,187 | 1/1977 | Kiejzik | 53/520 |
| 4,139,978 | 2/1979 | Jensen et al. | 53/520 X |
| 4,167,842 | 9/1979 | Dorman | 53/520 |
| 4,552,608 | 11/1985 | Hoffmann et al. | 53/51 X |
| 4,603,539 | 8/1986 | Müssig et al. | 53/435 |
| 4,787,766 | 11/1988 | Lörsch | 53/520 X |
| 4,821,061 | 4/1989 | Gudmundson et al. | 83/371 X |

*Primary Examiner*—Horace M. Culver
*Attorney, Agent, or Firm*—Sughrue, Mion, Zinn, Macpeak & Seas

[57] ABSTRACT

A cutting and sorting apparatus having a device for feeding a long continuous negative film in the longitudinal direction of the negative film, a cutter device for cutting the long continuous film at every perdetermined number of frames, a control device for controlling the cutting operation of the cutter device, and a negative film sheet loading device for loading a negative film sheet carrying protective sacks into which the cut segments of the negative film are to be inserted. The control device controls the operation of the cutter device such that the long continuous negative film is cut when the film has been fed by predetermined length after a frame number detection device detects of a specific frame number put on the negative film at a predetermined position. As a consequence, portions of the negative film segments corresponding to the frame numbers put on the negative film are located at predetermined positions in the protective sacks when the cut segments of the negative film are inserted into the respective protective sacks.

12 Claims, 4 Drawing Sheets

CUTTING AND SORTING APPARATUS

BACKGROUND OF THE INVENTION

1. Field of the Invention

The present invention relates to a cutting and sorting apparatus which conveys a long continuous photographic negative film after development and cuts the film at every predetermined number of frames so as to form film segments of a length suitable for insertion into a protective sack.

2. Description of Related Art

Commercial photographic developing service is usually conducted by connecting a plurality of long continuous photographic films of customers in series to form a train of long photographic films, and subjecting the film train to a continuous developing process. When the customer has placed an order for simultaneous printing, the negative film after the development is moved to bring the successive frames to a printing position so that the image carried by the negative film is printed on a photographic paper set in the printing position. After the printing, the negative film is inserted into translucent protective sacks for the negative film sheets and is returned to the customer together with the prints. Usually, the continuous long negative film is cut for every predetermined number of frames, e.g., for every 6 frames, into film segments of a predetermined length and such film segments are inserted into independent protective sacks before returned to the customer. An apparatus is commercially available which is capable of automatically conducting cutting of a continuous negative film into segments and insertion of the segments into protective sacks. An example of such an apparatus is a Cutting Inserter MODEL FNC1-3510 produced and sold by Fuji Photo Film Co., Ltd. This apparatus, referred to also as cutter sorter, is composed of a negative film cutter and a negative film inserter which are coupled such that the film segments cut from the continuous film are immediately inserted into the protective sacks.

In operation, once the long continuous negative film is set on the cutting inserter, the film is fed by a feeding means such as rollers and is cut at every predetermined number of frames into segments which are then inserted into protective sacks.

This known cutter sorter, however, suffers from the following problems. If the negative to be returned to the customer has been cut to remove the unnecessary portion which is on the leading side of the first successful exposure frame, the customer may have a suspicion that a successful exposure frame may have existed on the leading side of the first frame on the negative film segments inserted in the protective sacks and returned to the customer. In order to avoid such a suspicion, it is a common practice that all portions of the negative film, including the margin portion on the leading end for allowing extraction from a patron and other white blank portions on the leading side of the first successful exposure frame, is inserted into the protective sacks and returned to the customer.

The length of the film between the leading end and the first effective exposure frame varies depending on the state of loading of the film in the camera. Namely, the frame number 1 of the film may have been exposed during loading of the film so that this frame is made white after development. It is also possible that a first effective shot is obtained on a portion of the film which is on the leading side of the number 1 frame. Thus, the positional relationships between the frame numbers and the protective sacks undesirably vary depending on the position of the initial or first cutting of the film. This undesirably obliges the customer to confirm the numbers of frames on the film segments when placing an order for additional printing.

A problem also is encountered when additional printing is conducted in the developing factory. In the developing factory, an operator checks up the negative film with an order sheet to pick up the frames corresponding to the frame numbers written on the order sheet and prints such frames. The variance of the positional relationships between the frames and the protective sheet may cause the operator to pick up and print wrong frames. In order to avoid such an inconvenience, the operator is required to carefully read the frame numbers shown on the negative film.

SUMMARY OF THE INVENTION

Accordingly, an object of the present invention is to provide a cutting and sorting apparatus which is capable of cutting a long continuous negative film into film segments in such a manner that the frames of specific frame numbers are set in predetermined positions in the protective sacks when inserted into the protective sacks, thereby eliminating any risk of erroneous recognition of frames at the time of, for example, additional printing.

The present invention is cutting and sorting apparatus comprising: feeding means for feeding a long continuous film in the longitudinal direction of the film; cutting means for cutting the long continuous film at every predetermined number of frames on the film into film segments each containing the predetermined number of frames; film sheet loading means for loading a film sheet to which are connected a plurality of protective sacks for receiving the film segments; and control means for controlling the operation of the cutting means such that a frame of a specific frame number of each film segment is located at a predetermined position in the protective sack when inserted into the protective sack.

According to the present invention, when only the frame of the frame number 1 is to be contained in the first film segment, the long continuous negative film is cut to a length corresponding to a predetermined number of frames, e.g., 6 frames, including the image on the frame number 1 and the white blank portion on the leading side of this frame. Then, the second, third, fourth, fifth and subsequent film segments are cut such that each of these successive segments contain six frames, namely, frame numbers 2 to 7, 8 to 13, 14 to 19, 20 to 25 and so forth. The film segments are then inserted into protective sacks. Consequently, a predetermined relationship is obtained between the frame numbers and the positions of the frames in each protective sack, so that the desired frames can be correctly recognized without requiring careful check of the frame numbers appearing on the negative film when the frames are to be identified for the purpose of, for example, additional printing.

DESCRIPTION OF THE PREFERRED EMBODIMENTS

Figure 1:
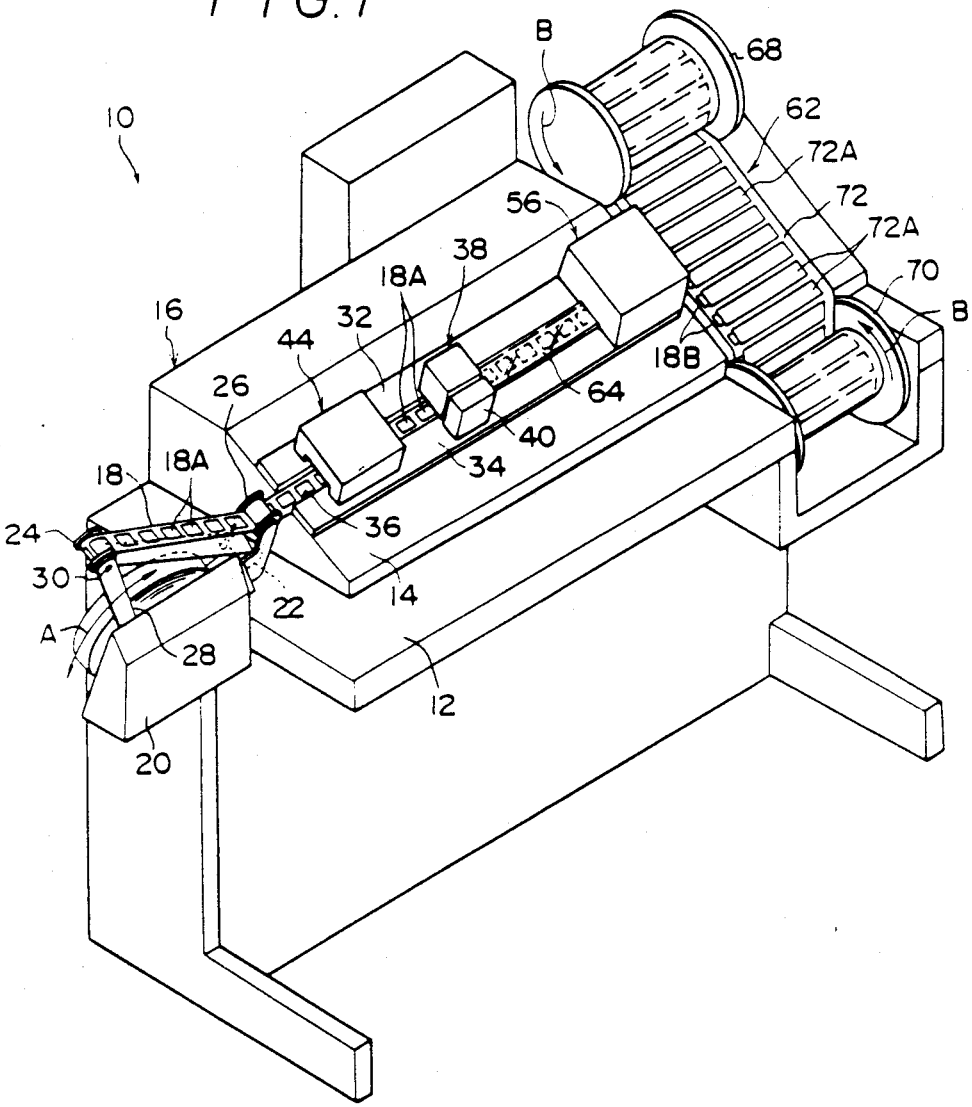
FIG. 1 is a perspective view of an embodiment of a cutting and sorting apparatus of the present invention.

FIG. 1 illustrates a cutting and sorting apparatus 10 embodying the present invention. The apparatus 10 has a main table 12 and a sub-table 16 placed on the main table 12 and having a slant surface 14 along which a negative film 18 is fed.

The negative film 18 is a long continuous film which is coiled in layers at its one end on a drum 19 (see FIG. 2) set in a negative film bracket 20. The negative film 18 extracted from the drum 19 is fed to the sub-table 16 while being guided by a roller 22, a tension roller 24 and a roller 26. An arm 28 is supported at its one end on the drum 19 through a rotary shaft 19A (see FIG. 2) and projects from the negative film bracket 20. The tension roller 24 is supported on the other end of the arm 28 through a shaft 30. The arm 28 is swingable about the axis of the drum in the direction of an arrow A so as to absorb any difference between the amount of the negative film 18 extracted from the drum and the amount of the negative film 18 fed on the sub-table 16 thereby maintaining a constant tension in the negative film 18.

A pair of parallel guide plates 32 and 34 are provided on the slant surface 14 of the sub-table 16 so as to guide the negative film 18 when the negative film 18 moves in the longitudinal direction thereof. Thus, the negative film 18 can be fed along a guide groove 36 formed between the guide plates 32 and 34 without any offset of its longitudinal axis. The feed of the negative film 18 is caused by a feeding unit 38 which is disposed on-longitudinal mid portions of both guide plates 32 and 34 so as to bridge over the path of feed of the negative film 18. The feeding unit 38 includes a stepping motor 40 driven in accordance with a signal from a control unit 52 and a pair of feed rollers 42 (see FIG. 2). The feed rollers are driven by the stepping motor 40 by an amount corresponding to the number of pulses supplied to the stepping motor 40, whereby feeding power is supplied to the negative film 18.

A negative film detection unit 44 is disposed upstream from the feeding unit 38 as viewed in the direction of movement of the negative film 18. As will be seen from FIG. 2, the negative film detection unit 44 is provided with a frame number detection device 46 which is connected through a signal line to the control unit 52.

The frame number detection device 46 is capable of reading bar codes provided in the vicinities of the respective frame 18A of the continuous long negative film 18 so as to detect the numbers of the frames on the negative film 18 which is being fed.

Figure 2:
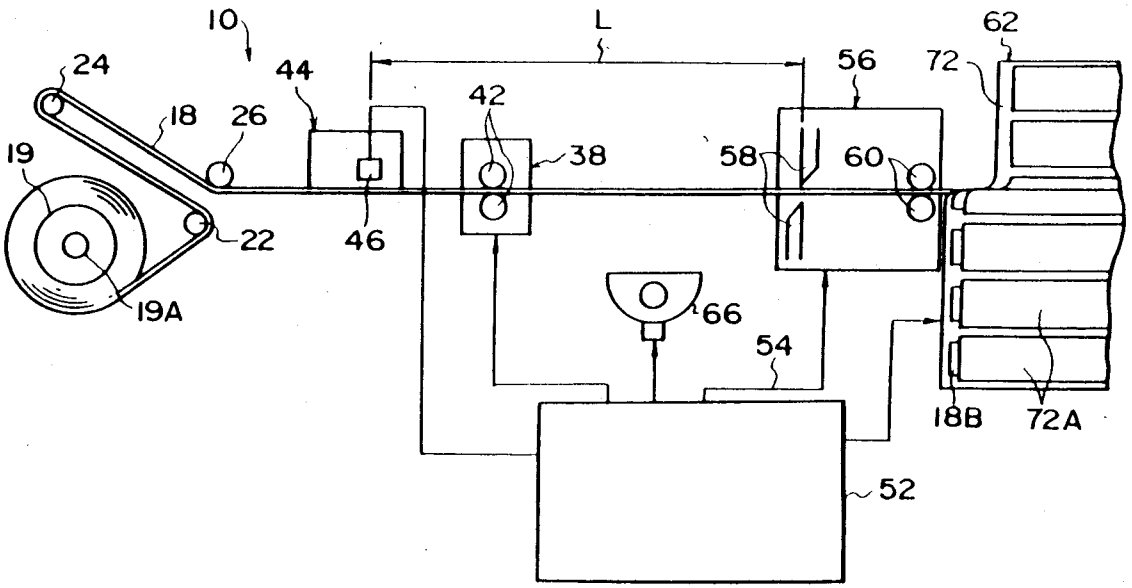
FIG. 2 is a schematic illustration of the cutting and sorting apparatus of FIG. 1 and equipment around the apparatus.

A cutter unit 56 disposed downstream of the feeding unit 38 has, as shown in FIG. 2, a cutter blade 58 driven by a signal from the control unit 52 and a pair of feeding rollers 60. In operation, the cutting blade 58 cuts the negative film 18 while the leading end of the negative film 18 is pinched between the feeding rollers 60.

The amount of feed of the negative film 18 per one cycle of operation corresponds to 6 frames 18A. In consequence, the long continuous negative film 18 is cut into film segments each having 6 frames. The film segment 18B thus obtained is fed by the feeding rollers towards a negative film segment insertion unit 62.

A transparent glass sheet 64 is placed above the portion of the negative film 18 between the feeding unit 38 and the cutter unit 56. The transparent glass sheet 54 eliminates any slack of the negative film 18 during feeding so as to enable the negative film 18 to be correctly and securely fed to the cutter unit 56. An opening (not shown) is provided under the path of the negative film 18 at a position corresponding to the transparent glass plate 64. As will be seen from FIG. 2, light from a light source 66 connected to the control unit 52 is made to pass through this opening. In consequence, the light from the light source 66 is transmitted through the image on the negative film so as to enable an operator to visually check the image.

The negative film segment insertion unit 62 includes a delivery drum 68 disposed at one end of the sub-table 16 at an elevated position and a take-up drum 70 disposed at one side of the main table 12. The arrangement is such that a negative film sheet 72 which has a plurality of consecutive protective sacks 72A is delivered from the delivery drum 68 and taken up by the take-up drum 70. The delivery drum 68 and the take-up drum 70 are so arranged that the negative film sheet 72 between these drums is guided along a plate flush with the slant surface 14 of the sub-table 16, so that the negative film segment 18B is inserted into one of the consecutive protective sacks which is disposed immediately downstream from the cutter unit 56. When the negative film segment 18B has been inserted into the protective sack 72A, the delivery drum 68 and the take-up drum 70 are rotated in the direction of arrow B in FIG. 1 in accordance with a signal from the control unit 52 so as to locate the next protective sack 72A is located at the insert position immediately downstream of the cutter unit 56. Thus, the feed of the negative film sheet 72 is conducted in synchronization with the cutting of the negative film 18 conducted by the cutter unit 56 so that negative film segments 18B are inserted into the protective sacks 72A successively.

In this embodiment, the first cutting for severing the first negative film segment 18B is conducted such that the frame number 1 is on the downstream end of the severed negative film segment 18B as viewed in the direction of insertion. Namely, the cutting unit 56 is operated when the negative film 18 has been fed by a predetermined length after detection of the frame 18A of the frame number 1 by the frame number detection device 46 or when the film has been fed by a predetermined time after the detection of the frame 18A of the frame number 1, so that a constant length of a film portion is obtained which contains white blank portion 1C (see FIG. 3) on the leading side of the frame 18A of the frame number 1 and the margin 18D (see FIG. 3) for film extraction from the patron. Thus, the distance L between the position where the frame number is detected by the frame number detection device 46 and the position at which the film is cut by the cutting unit 58 is the sum of the length of the negative film segment 18B and the above-mentioned predetermined length. In consequence, the first negative film segment 18B has a length corresponding to 6 frames, though it contains only one successfully exposed image frame 18A. Then, the cutting operation is successively conducted to cut the negative film 18 at positions between the frames numbers 1 and 2, between the frames numbers 7 and 8 and so on such that fixed positional relationships are obtained between the frames of the respective negative film segments and the protective sacks receiving these negative film segments.

The operation of this embodiment will be described hereinunder.

The negative film 18 is unrolled from the drum 19 as a result of rotation of the drum 19 and is fed to the sub-table 12 while being guided by the roller 22, tension roller 24 and the roller 26 and is introduced into the space defined between the pair of guide plates 32 and 34 provided on the sub-table 16. These guide plates 32 and 34 effectively guide the breadthwise ends of the negative film 18 so as to keep the longitudinal axis of the negative film in alignment with a predetermined line.

Figure 3:
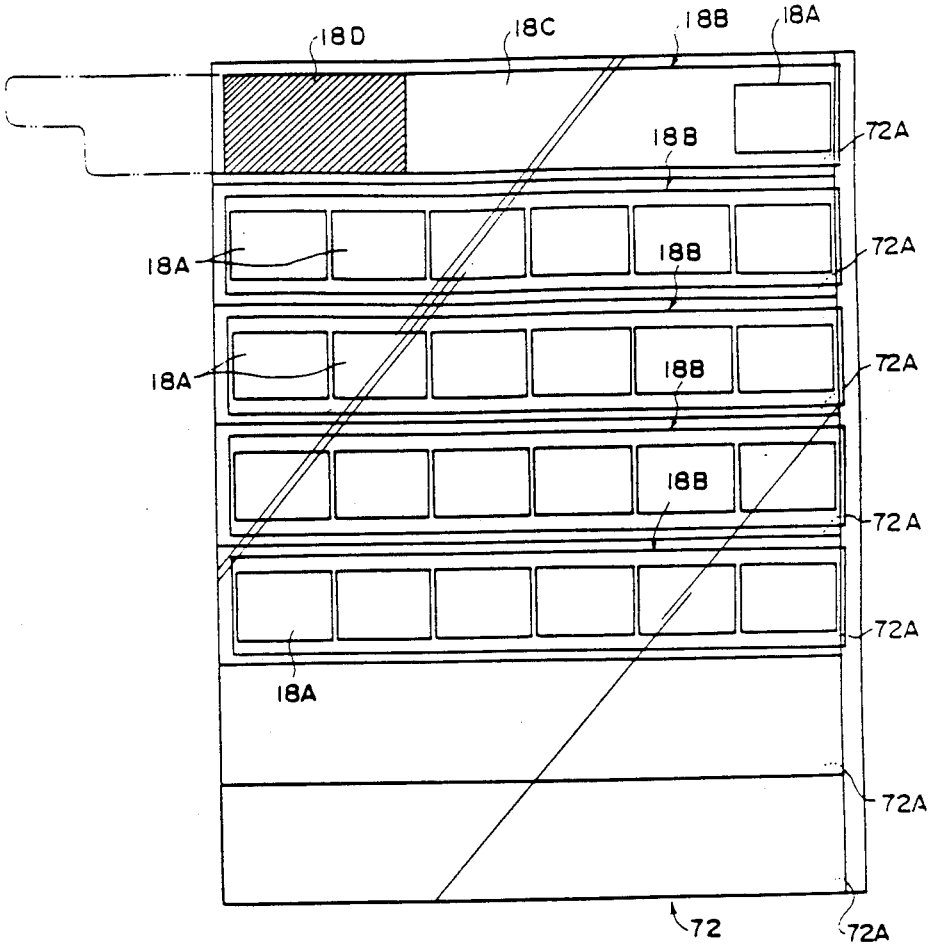
FIG. 3 is a plan view of the cutting and sorting apparatus, illustrative of the operation for inserting the cut film segments into protective sacks.

In the cutting and sorting apparatus of the present invention, the first cutting is executed when the film has been fed by a predetermined length after detection of the frame 18A of the frame number 1 by the frame number detection device 46, so that the unnecessary leading end portion shown by the dotted line in FIG. 3 is severed. Then, the second cutting is executed when the negative film 18 has been fed by a length corresponding to 6 frames after the first cutting, whereby a first negative film segment 18B containing only one exposed image frame 18A is obtained.

Thereafter, the negative film 18 on the sub-table 16 is fed by the operation of the stepping motor 40 precisely the amount corresponding to 6 frames and then stopped. The negative film 18 is stopped in the cutting unit 56, pinched at its leading end by the pair of feeding rollers 60, and the cutting blade 58 is activated in this state to cut the negative film 18A. The negative film 18 in the cutting unit 56 is so located such that the portion of the film between two successive frames 18A and 18A is precisely cut.

The negative film segment 18B, thus obtained, is further fed by the feed rollers 60 and inserted into the protective sack 72A disposed downstream from the cutter unit 56.

When the negative film segment 18B has been inserted into the protective sack 72A, the delivery drum 68 and the take-up drum 70 are driven in the direction of the arrow B in FIG. 1, so that the next protective sack 72A is located at a position immediately downstream from the cutting unit 56. Simultaneously, along with the feed of the negative film sheet 72, the stepping motor 50 is operated to advance the negative film 18 by a length corresponding to 6 frames so that the portion of the negative film 18 to be cut next is brought to the cutting position. This operation is repeated consecutively so that negative film segments 18B are successively fed into the protective sacks 72A. During this operation, the operator can visually check images on the negative film 18 through the glass sheet 64 disposed downstream from the sub-table 16 as the negative film 18 is illuminated from the lower side through the vacancy formed in the sub-table 16.

According to the invention, the long continuous negative film is cut into negative film segments such that the first negative film segment 18B contains only the frame 18A of the frame number 1 in addition to the white blank portion 18C and film extraction margin portion 18D on the leading side of the first frame. Consequently, a constant predetermined positional relationship is obtained between the frame numbers of each negative film segment and the protective sack receiving the negative film segment.

This constant positional relationship between the frames of each negative film segment and the protective sack receiving the segment enables the customer to correctly identify and appoint the frame or frames when placing an order for additional prints.

Figure 4:
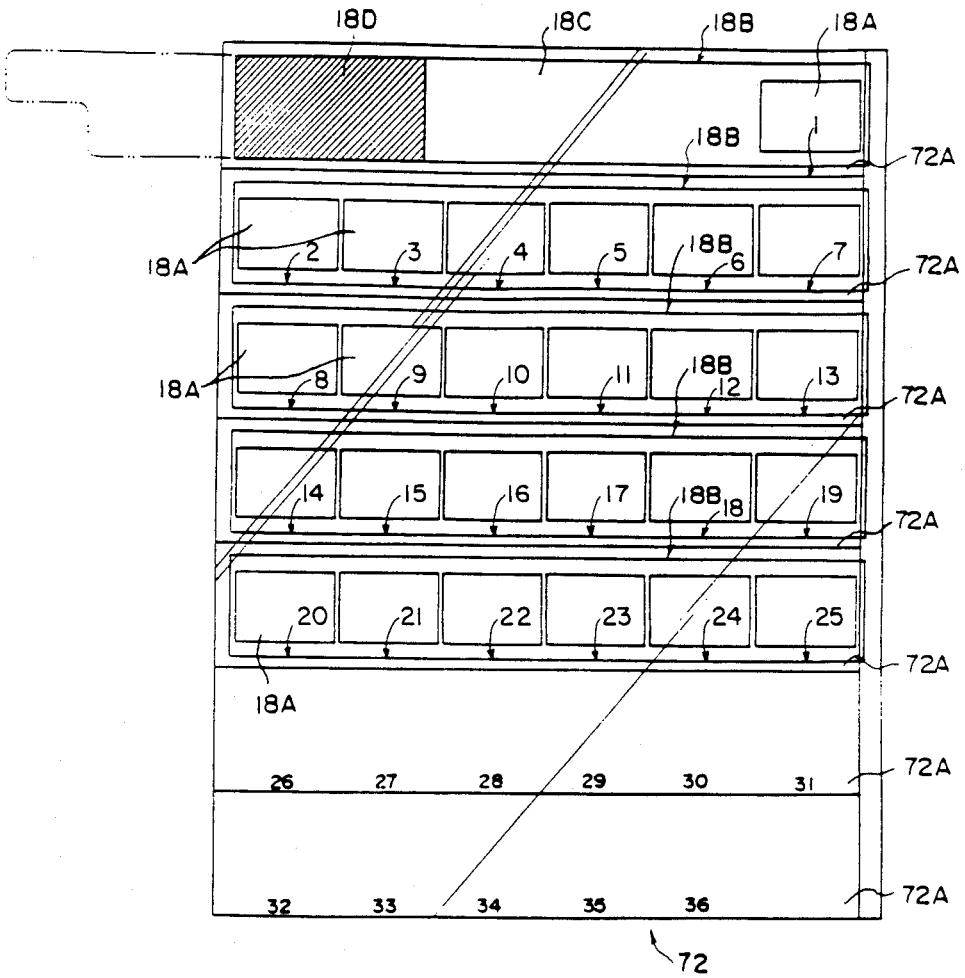
FIG. 4 is a plan view of an embodiment in which identification numbers are put on a negative film sheet.

The described embodiment enables the frames of the respective negative film segments to be correctly located with respect to the protective sacks. In order to further facilitate the identification of the frames, the negative film sheet 72 may be provided with frame numbers previously printed in order on the successive protective sacks as shown in FIG. 4. It will be understood that this arrangement enables at-a-glance identification of the frames without requiring confirmation of the frame numbers put on the negative film segments inside the protective sack 72A. It is generally preferable to mark the frame numbers which is easy to understand on the position of the frame number put on the negative film to the corresponding frame. For example, S, E or 1A, 2A, 3A or 1A–2, 2A–3 and so on are preferable to number 1, 2, 3.

In the described embodiment, the first negative film segment 18B contains only one effective frame 18A which is identified as the frame number 1. This however, is not exclusive and the first negative film segment may be formed such that it contains two effective frame, e.g., frame numbers 1 and 2 together with the extraction margin portion and the white blank portion on the leading end of the frame number 1. In some cases, an effective frame 18A, frame number S, occurs at the leading side of frame number 1. In such a case, the first negative film segment 18B may be formed such that it contains only one effective frame 18A, frame number S, together with the film extraction margin portion and the white blank portion.

In the described embodiment, the frame number detection device 46 is used for detecting the frame number on the negative film and the film is fed by a predetermined length before cutting after detection of a specific frame number by the frame number detection device 46. The use of such a system, however, is not essential. Namely, the arrangement may be such that the operator visually confirms the frame number only for the first cutting and gives a cutting instruction through a button to effect the first cutting.

Additionally, the cutting and insertion of the negative film may be conducted in the opposite direction as described in the embodiment, i.e., in such a direction that the long continuous negative film 18 is fed with its end carrying the last frame put on the leading side.

As described above, the present invention can cut a long continuous negative film into negative film segments each containing a predetermined number of frames, then insert the negative film segments into successive protective sacks such that predetermined positional relationships are obtained between each protective sack and the frame numbers of the frames carried by the negative film segment inserted in the protective sack.

What is claimed is:

1. A cutting and sorting apparatus comprising:

means for transporting a long continuous film to the longitudinal direction of said film;

means for cutting the transported film at every predetermined number of frames on said film into film segments each containing said predetermined number of frames;

means for loading a film sheet to which are attached a plurality of protective sacks for receiving said film segments; and means for controlling the operation of said cutting means such that a frame of a specific frame number of each film segment is located at a predetermined position in the protective sack when said film segment is inserted into said protective sack.

2. A cutting and sorting apparatus according to claim 1, 1, wherein said control apparatus is operative to control said cutting apparatus in response to direction of said specific frame number of said film by said detection apparatus, to control the transport of said film a predetermined distance, and to control said cutting apparatus to cut said film at a predetermined cutting position.

3. A cutting and sorting apparatus according to claim 2, further comprising detection means for detecting a frame number located on said portion of said film.

4. A cutting and sorting apparatus according to claim 2, wherein said protective sacks have been previously marked with numerals indicating frame numbers corresponding to said frame numbers of said film, and said means for loading inserts said film segments into said protective sacks such that said frame numbers on said film segments correspond to said frame numbers on said protective sacks.

5. A cutting and sorting apparatus according to claim 2, further comprising means for eliminating any slack of said long continuous film during transportation of said film, said eliminating means includes a transparent member for allowing said film to be viewed.

6. A cutting and sorting apparatus comprising:

feeding apparatus for feeding a long continuous negative film in the longitudinal direction of said film;

cutting apparatus for cutting the transported negative film at every predetermined number of frames on said film into negative film segments each containing said predetermined number of frames;

film sheet loading apparatus for loading a film sheet to which are attached a plurality of protective sacks for receiving said negative film segments; and control apparatus for controlling the operation of said cutting apparatus such that a frame of a specific frame number of each negative film segment is located at a predetermined position in the protective sack when said negative film segment is inserted into said protective sack.

7. A cutting and sorting apparatus according to claim 6, further comprising detection apparatus for detecting a frame number put on said negative film for enabling identification of a preselected portion of said negative film.

8. A cutting and sorting apparatus according to claim 7, wherein said control apparatus is operative to control said cutting apparatus in response to direction of said specific frame number of said negative film by said detection apparatus, to control the transport of said negative film a predetermined distance, and to control said cutting apparatus to cut said negative film at a predetermined cutting position.

9. A cutting and sorting apparatus according to claim 8, wherein said protective sacks have been previously marked with numerals indicating frame numbers corresponding to said frame numbers of said negative film, and said negative film segments are inserted into said protective sacks such that said frame numbers on said negative film segments correspond to said frame numbers on said protective sacks.

10. A cutting and sorting apparatus according to claim 6, further comprising apparatus for eliminating any slack of said long continuous film during transportation of said film, said eliminating means includes a transparent member for allowing said film to be viewed.

11. A cutting and sorting method for a negative film, comprising the steps of:

transporting a long continuous negative film in the longitudinal direction of said film;

detecting, during the transportation of said negative film, a frame number which is put on said negative film and which enables identification of a preselected portion of said negative film; and cutting the transported negative film at every predetermined number of frames such that a frame of a frame number used as a reference for the cutting position is located at a predetermined position of a protective sack when a negative film segment formed by the cutting is inserted into said protective sack.

12. A cutting and sorting method according to claim 11, wherein the step of cutting said negative film is conducted when said negative film has been fed by a predetermined amount from a predetermined position after a moment at which said step of detecting said frame number at the predetermined position.

* * * * *